US007485363B2

(12) United States Patent
Guevel et al.

(10) Patent No.: US 7,485,363 B2
(45) Date of Patent: Feb. 3, 2009

(54) YARN INTENDED FOR MAKING UP A CUT-RESISTANT AND ABRASION-RESISTANT TEXTILE SURFACE

(75) Inventors: Jean Guevel, Jassans Riottier (FR); Guy Bontemps, Tenay (FR)

(73) Assignee: SA Schappe (FR)

( * ) Notice: Subject to any disclaimer, the term of this patent is extended or adjusted under 35 U.S.C. 154(b) by 0 days.

(21) Appl. No.: 11/781,400

(22) Filed: Jul. 23, 2007

(65) Prior Publication Data

US 2008/0032131 A1 Feb. 7, 2008

(30) Foreign Application Priority Data

Jul. 21, 2006 (FR) ..... 06 06689

(51) Int. Cl.
*D02G 3/00* (2006.01)

(52) U.S. Cl. ..... 428/359; 428/357; 428/364

(58) Field of Classification Search ..... 428/359, 428/357, 364, 394; 57/210
See application file for complete search history.

(56) References Cited

U.S. PATENT DOCUMENTS 3,538,564 A * 11/1970 Skoler et al. ..... 28/109
3,621,646 A * 11/1971 Bobkowicz et al. ..... 57/224
4,324,827 A * 4/1982 Obayashi et al. ..... 428/192
4,410,575 A * 10/1983 Obayashi et al. ..... 428/57
4,840,021 A * 6/1989 Guevel et al. ..... 57/210
4,918,912 A 4/1990 Warner
5,910,361 A * 6/1999 Guevel et al. ..... 428/364
6,254,988 B1 * 7/2001 Zhu et al. ..... 428/373
6,829,881 B1 12/2004 Manten
6,880,321 B2 * 4/2005 Guevel et al. ..... 57/229
6,887,568 B2 * 5/2005 Guevel et al. ..... 428/370
7,065,949 B2 * 6/2006 Guevel et al. ..... 57/229
2003/0037530 A1 2/2003 Zhu
2004/0053048 A1 * 3/2004 Guevel et al. ..... 428/373
2004/0148921 A1 8/2004 Guevel et al.
2008/0032131 A1 * 2/2008 Guevel et al. ..... 428/401

FOREIGN PATENT DOCUMENTS

EP 0 962 313 12/1999
WO 01/98568 12/2001
WO WO 2004033773 A1 * 4/2004

* cited by examiner

*Primary Examiner*—N. Edwards
(74) *Attorney, Agent, or Firm*—Cantor Colburn LLP

(57) ABSTRACT

Yarn intended for making up a cut-resistant and abrasion-resistant textile surface, characterized in that it is obtained by spinning high-tenacity polyamide staple fibers, the tenacity of which is greater than 4.5 cN/dtex and the length of the fibers of which is between 40 and 170 mm.

12 Claims, 1 Drawing Sheet

YARN INTENDED FOR MAKING UP A CUT-RESISTANT AND ABRASION-RESISTANT TEXTILE SURFACE

TECHNICAL FIELD OF THE INVENTION

The invention relates to a yarn intended for making up a cut-resistant and abrasion-resistant textile surface.

BRIEF DESCRIPTION OF RELATED ART

It is known from documents U.S. Pat. No. 3,883,898, GB 1 586 890, U.S. Pat. Nos. 4,777,789, 4,004,295, GB 2 018 323, DE 1 610 495 and EP 0 118 898 that the use of fibrous polymers of various kinds, whether or not reinforced with inorganic, for example glass or metal, fibers or filaments, makes it possible to achieve good cut resistance.

It should be noted that the cut resistance is governed in Europe by the EN 388 standard, which defines five performance levels, called classes, ranging from 1 to 5 and increasing with the level of performance.

In nonreinforced products based on organic fibers, the choice of materials is rather restricted. The materials generally used are polyphenylene terephthalamide (PPTA), liquid crystal polymer (LCP) or high-molecular-weight polyethylene, that is to say one having a molar mass of greater than 600 000 g/mol. The fibers thus formed may be used by themselves or combined with polyamide fibers.

All these polymers, called engineering polymers, have in common a high modulus and a very high mechanical strength. However, the modulus is rarely greater than 100 GPa, with a tensile strength of greater than 2000 MPa.

These very high modulus values for organic fibers are however much lower than those that correspond to inorganic fibers of the carbon, silicon carbide (SiC) or superalloy type.

High modulus values are synonymous in general with stiffness, and often make it very difficult for operators to be able to grip things, giving them some discomfort. In this case, operators cannot wear protective devices, which in most cases are used in the form of gloves.

For the great majority of applications, these gloves are knitted on special machines that make it possible to produce gloves not requiring rework.

Three types of machine, defined according to their gauge, that is to say the number of needles per inch, are generally used.

A first type of machine, defined by a gauge 7, allows the manufacture of heavy gloves, which are protective but not very user-friendly. Second and third types, defined by a gauge 10 and a gauge 13 respectively, are used to produce medium-grade gloves and fine-grade gloves respectively.

Medium-grade gloves are the most used, especially in the automobile industry, in mechanical and electrical engineering, in the glass industry, in the packaging industry or else for handling purposes. These industries use in general gloves manufactured in gauge 10 and meet the requirements of Class 3 defined by the EN 388 standard.

Apart from the drawbacks described above, relating to the stiffness of engineering polymers, these products are very costly. In some industries, this often constrains decision-makers to accepting ill-suited solutions, such as cotton or leather gloves, and thus exposing operators both to discomfort and to the risk of injury.

In addition, end-of-life recycling of the products poses the problem of cost and of damage to the environment.

Two solutions exist, namely controlled-discharge dumping and incineration. In the latter case, certain polymers generate hazardous substances, such as hydrocyanic acid (HCN) and other undesirable compounds.

SUMMARY OF THE INVENTION

The invention remedies the above drawbacks by providing a yarn intended for making up a cut-resistant and abrasion-resistant textile surface that meets the requirements of Class 3 of the EN 388 standard, while improving user comfort and recyclability of the products produced, while reducing their manufacturing costs.

For this purpose, the subject of the invention is a yarn intended for making up a cut-resistant and abrasion-resistant textile surface, characterized in that it is obtained by spinning high-tenacity polyamide staple fibers, the tenacity of which is greater than 4.5 cN/dtex and the length of the fibers of which is between 40 and 170 mm.

According to a first embodiment, the fibers are converted by cracking, by cutting, by carding or by drawing, and have a length of between 65 and 140 mm.

According to a second embodiment, the fibers are converted by cottonizing and have a length of between 40 and 65 mm.

Preferably, the yarn comprises polyvinyl alcohol fibers of the HPF (high performance fiber) type, the modulus of which is greater than 10 GPa.

This type of fiber makes it possible to improve the cutting performance of the yarn.

According to another feature of the invention, the yarn comprises textured nylon-6,6 polyamide fibers. This type of fiber improves the abrasion behavior of the yarn.

Advantageously, the proportion of high-tenacity polyamide is between 15 and 85% of the total weight of the entire yarn.

Preferably, the proportion of textured polyamide is between 5 and 30% of the total weight of the entire yarn.

According to one feature of the invention, the fineness of the high-tenacity polyamide fibers is between 0.5 and 8 dtex.

According to one option of the invention, the fineness of the HPF polyamide fibers is between 0.5 and 8 dtex.

Advantageously, the total yarn count is between Nm 2.5 and Nm 50.

According to an alternative, the yarn is produced in the form of a primary yarn, the twist coefficient of the primary yarn being between 30 and 90.

According to another possibility, the yarn is produced in the form of a twist yarn, the twist coefficient of the twist yarn being between 25 and 85.

The invention also relates to a textile surface formed from yarns according to the invention.

BRIEF DESCRIPTION OF THE DRAWING

In any case, the invention will be well understood from the following description, with reference to the appended schematic drawing.

DETAILED DESCRIPTION OF THE INVENTION

Figure 1:
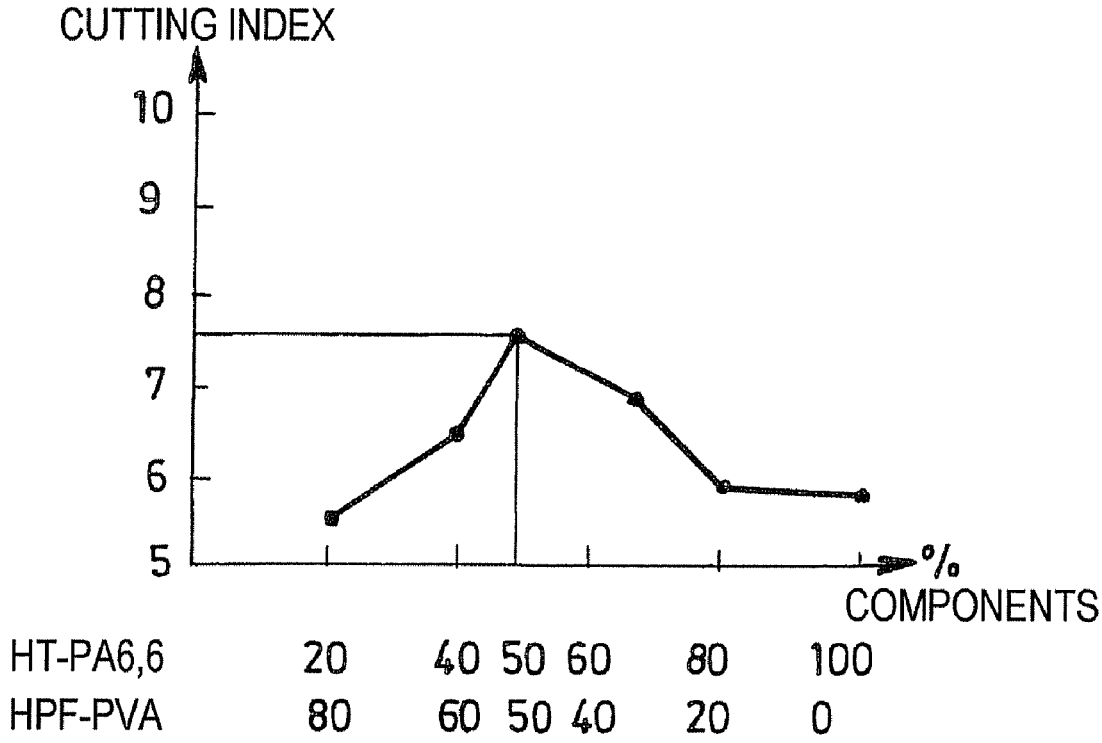
FIG. 1 is a diagram showing the variation in the cutting index as a function of the composition of the fibers of the yarn.

To produce the yarn according to the invention, two families of polymers are used, both being recyclable, namely:

- high-tenacity polyamide, also called HT-PA; and
- HPF (high performance fiber)-type polyvinyl alcohol also called HPF-PVA.

These two polymers are semicrystalline thermoplastics. More particularly, the high-tenacity polyamide used may be of the type intended for reinforcing tires and pressurized hoses, which is not normally used for fine textiles, but which does possess good cutting resistance properties.

The yarn comprises high-tenacity nylon-6,6 polyamide fibers, the tenacity of which is greater than 4.5 cN/dtex and the unitary count is between 2.5 and 7 dtex. The fibers are obtained by a slow progressive cracking process, given their high strength, between 6 and 12 cN/dtex. However, they possess a high elongation at break, giving the product a modulus of less than 10 GPa. This low modulus allows knitted gloves to be produced that are comfortable for the wearer.

The yarn furthermore includes HPF polyvinyl alcohol fibers, the modulus of which is greater than 10 GPa. This type of fiber is generally used for reinforcing cement.

These fibers have also been chosen for their high mechanical strength, of around 11 cN/dtex for a high elongation at break, of around 8%, giving the fibers a modulus of around 20 GPa. These fibers have a fineness of between 2 and 5 dtex, and were produced by a slow progressive cracking process, given their high strength.

The high-tenacity polyamide fibers and the HPF polyvinyl alcohol fibers have average lengths compatible with the spinning process, namely between 40 and 170 mm, preferably between 80 and 110 mm.

The yarn is preferably formed by spinning, from HT-PA staple fibers and HPF-PVA staple fibers. They could also, alternatively, be produced only from HT-PA staple fibers.

It is also possible to mix with HT-PA and HPF-PVA fibers a textured nylon-6,6 polyamide fiber filament, which may for example represent between 15 and 25% of the total mass of the yarn. Such a mixture allows the abrasion-resistance properties to be enhanced.

The yarn used is preferably of the Nm 28/2 type, that is to say a two-strand twist yarn for which 28 km of the yarn may be obtained from 1 kg of material.

The yarn is composed of a primary yarn and a secondary yarn. For each of the yarns, the twist coefficient is defined, this being deduced from the following formula:

$$T=\alpha(Nm)^{1/2}$$

where $T$ = twist in turns/m;

$\alpha$ = twist coefficient (dimensionless);

= metric number in m/g.

The twist coefficient $\alpha$ of the Nm 25/1 (35.7 tex) primary yarn is between 30 and 90. The twist coefficient of the twist yarn is between 25 and 85. It should be noted that the twist coefficient exerts most particularly an influence on the comfort and the abrasion resistance. This parameter has little effect on the cutting resistance.

The best compromise is obtained for a twist coefficient of around 60 on the primary yarn and around 55 on the twist yarn. In the case in which a textured polyamide filament is added, the twist coefficient of the latter is substantially equal to that of the twist yarn.

To check whether this yarn allows textile surfaces to be produced that meet the EN 388 standard as regards the requirements relating to cutting protection, gloves were produced by knitting on a gauge 10 knitting machine. These gloves were then tested according to the criteria of the EN 388 standard.

The table below gives the results of the tests carried out at the technical center. It summarizes, according to the type of yarn used, the index and the class achieved as regards the requirements relating to cutting resistance and abrasion resistance respectively.

The cutting index is of more particular interest by this being proportional to the number of passes that the test blade loaded with a certain weight, defined by the standard, must perform. Thus, the higher the cutting index within a class, the more cut-resistant the product. In order for the product to meet the requirements of Class 3 as regards cutting resistance, the cutting index must be between 5 and 10.

Four types of yarn were thus tested, namely:

- a yarn of Nm 28/2 type, composed exclusively of HT-PA fibers;
- a yarn of Nm 28/2 type, composed exclusively of HPF-PVA fibers;
- a yarn of Nm 28/2 type, comprising 50% by weight of HT-PA fibers and 50% by weight of HPF-PVA fibers; and
- a yarn of Nm 28/2 type, comprising 41% by weight of HT-PA fibers, 41% by weight of HPF-PVA fibers and 18% by weight of textured nylon-6,6 polyamide filament.

| Type of yarn | Cutting | Abrasion |
|---|---|---|
| Nm 28/2<br>100% HT-PA | Index 5.9<br>Class 3 | 500 < index < 2000<br>Class 3 |
| Nm 28/2<br>100% HPF-PVA | Index 4.6<br>Class 2 | 100 < index < 500<br>Class 3 |
| Nm 28/2<br>50% HT-PA<br>50% HPF-PVA | Index 7.5<br>Class 3 | 500 < index < 2000<br>Class 3 |
| Nm 28/2<br>41% HT-PA<br>41% HPF-PVA<br>18% textured PA6,6 filament | Index 8.5<br>Class 3 | Index > 8000<br>Class 4 |

It should be noted that all the yarn types, except that composed exclusively of HPF-PVA fibers, meet the requirements of Class 3 as regards cutting protection.

Furthermore, by comparing the last two types of yarn, it may be noted that mixing a textured nylon-6,6 polyamide filament improves the properties of the product, especially with respect to abrasion.

FIG. 1 shows the variation in the cutting index as a function of the HT-PA and HPF-PVA composition of the yarn.

This shows that the highest cutting index is obtained for a yarn composition comprising 50% by weight of HT-PA fibers and 50% by weight of HPF-PVA fibers. It may also be noted, as is also apparent from the above table, that a yarn composed exclusively of HT-PA fibers meets the requirements of Class 3.

As goes without saying, the invention is not limited to just the compositions of this yarn described above by way of examples; it encompasses, on the contrary, all variants thereof.

Applicant respectfully asserts that no new matter is being added to the Original Application via amendments made in any Substitute Specification subsequently filed in this Application.

The invention claimed is:

1. A yarn intended for making up a cut-resistant and abrasion-resistant textile surface, comprising spun high-tenacity polyamide staple fibers, the tenacity of which is greater than 4.5 cN/dtex and the length of the fibers of which is between 40 and 170 mm, wherein the yarn includes polyvinyl alcohol fiber of the HPF (high performance fiber) type, a modulus of which is greater than 10 GPa.

2. The yarn as claimed in claim 1, wherein the fibers are converted by cracking, by cutting, by carding or by drawing, and have a length of between 65 and 140 mm.

3. The yarn as claimed in claim 1, wherein the fibers are converted by cottonizing and have a length of between 40 and 65 mm.

4. The yarn as claimed in claim 1, which comprises textured nylon-6,6 polyamide fibers.

5. The yarn as claimed claim 1, wherein a proportion of high-tenacity polyamide is between 15 and 85% of a total weight of the entire yarn.

6. The yarn as claimed in claim 4, wherein a proportion of textured polyamide is between 5 and 30% of the total weight of the entire yarn.

7. The yarn as claimed in claim 1, wherein a fineness of the high-tenacity polyamide fibers is between 0.5 and 8 dtex.

8. The yarn as claimed in claim 1, wherein a fineness of the HPF polyamide fibers is between 0.5 and 8 dtex, their tenacity being greater than 4.5 cN/tex.

9. The yarn as claimed in claim 1, wherein a total yarn count is between Nm 2.5 and Nm 50.

10. The yarn as claimed in claim 1, which is produced in a form of a primary yarn, a twist coefficient of the primary yarn being between 30 and 90.

11. The yarn as claimed in claim 1, which is produced in a form of a twist yarn, a twist coefficient of the twist yarn being between 25 and 85.

12. A textile surface formed from yarns as claimed in claim 1.

* * * * *